United States Patent [19]

Longsdorf

[11] Patent Number: 4,804,958

[45] Date of Patent: Feb. 14, 1989

[54] TWO-WIRE TRANSMITTER WITH THRESHOLD DETECTION CIRCUIT

[75] Inventor: Randy J. Longsdorf, Chaska, Minn.

[73] Assignee: Rosemount Inc., Eden Prairie, Minn.

[21] Appl. No.: 107,297

[22] Filed: Oct. 9, 1987

[51] Int. Cl.[4] ..... G08C 9/06; G08C 19/02

[52] U.S. Cl. ..... 340/870.07; 340/870.16; 340/870.38; 340/870.42

[58] Field of Search ..... 340/870.07, 870.16, 340/870.39, 870.42, 870.38; 324/62; 364/571

[56] References Cited

U.S. PATENT DOCUMENTS

| | | | |
|---|---|---|---|
| 4,242,665 | 12/1980 | Mate | 340/870.39 |
| 4,296,413 | 10/1981 | Milkovic | 340/870.38 |
| 4,339,750 | 7/1982 | Delacruz | 340/870.39 |
| 4,414,853 | 11/1983 | Bryzek | 340/870.42 |

*Primary Examiner*—John W. Caldwell, Sr.

*Assistant Examiner*—Tyrone Queen

*Attorney, Agent, or Firm*—Kinney & Lange

[57] ABSTRACT

A threshold detection circuit for improving the output of a two-wire transmitter is disclosed. The transmitter comprises a sensing means which has a sensor responsive to a parameter to be sensed by the transmitter and an excitation means which provides an excitation output to excite the sensor. A threshold detection circuit is coupled to the sensor output and provides a detector output representative of an undesired change in excitation output which can produce a sensor output not substantially representative of the sensed parameter. An output means is coupled to the sensor output and detector output and provides the transmitter output as a function of the sensor output and detector output. A distinctive transmitter output representative of an undesired change in excitation output thus detected is provided, thereby improving the transmitter output.

7 Claims, 2 Drawing Sheets

TWO-WIRE TRANSMITTER WITH THRESHOLD DETECTION CIRCUIT

BACKGROUND OF THE INVENTION

Field of the Invention

The present invention relates to a threshold detection circuit for improving the output of a two-wire transmitter.

SUMMARY OF THE INVENTION

The present invention relates to a two-wire current transmitter for providing a transmitter output representative of a parameter to be sensed. The transmitter comprises a sensing means which has a sensor responsive to the parameter and an excitation means for providing an excitation output to excite the sensor. The sensing means provides a sensor output which varies as a function of the excitation output and the sensed parameter. The transmitter has an output means coupled to the sensor output for providing the transmitter output as a function of the sensor output to a two-wire circuit. An undesired change in the excitation output, however, can cause a sensor output which is not substantially representative of the parameter to be sensed. According to the present invention, the transmitter has a threshold detection means coupled to the sensor output, having at least one predetermined threshold value corresponding to a predetermined sensor output value produced in response to such undesired change in excitation output. The threshold detection means compares the sensor output against the threshold value and provides a detector output to the output means as a function of such comparison. Following detection of an undesired change in excitation output, for example, the output means provides a distinctive transmitter output representative of such event, thereby improving the output of the transmitter.

In one preferred embodiment, the sensing means further comprises means for feedback of the sensor output to the sensing means such that the excitation output varies as a function of the sensor output. In another preferred embodiment, the excitation means comprises an oscillator means for providing a time varying oscillator output for exciting the sensor, and wherein the feedback means further comprises a control means coupled to the sensor output and the oscillator means for controlling the oscillator output as a function of the sensor output.

DETAILED DESCRIPTION OF THE PREFERRED EMBODIMENTS

Figure 1:
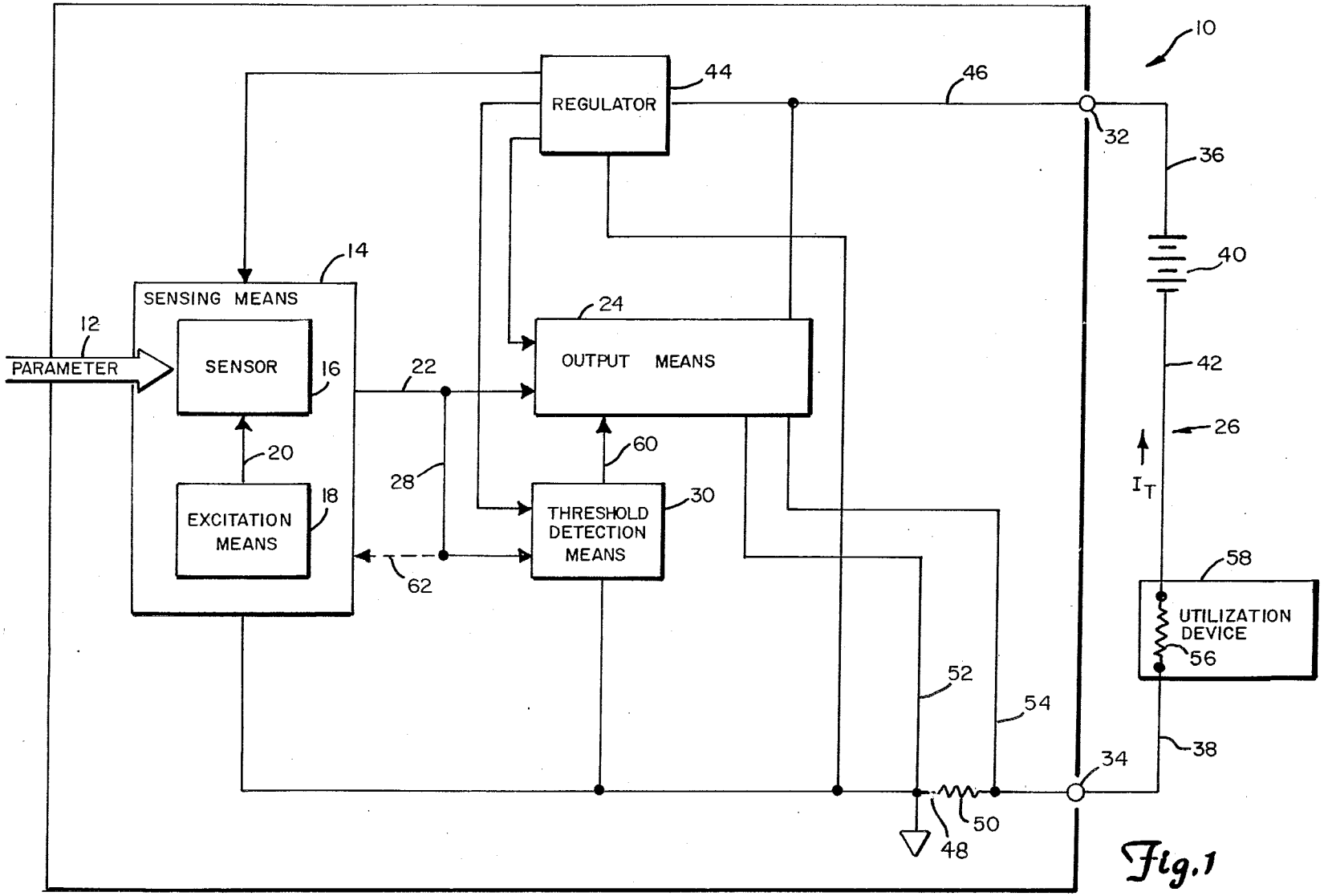
FIG. 1 is a block diagram representation of a preferred embodiment of a two-wire transmitter having a threshold detection circuit according to the present invention.

In FIG. 1 a preferred embodiment of a two-wire current transmitter made according to this invention is indicated generally at 10. Transmitter 10 couples to a parameter to be sensed, as indicated at arrow 12. The parameter of arrow 12 can comprise absolute, gauge or differential pressure, temperature, pH, flow, conductivity or the like. Transmitter 10 senses the parameter at arrow 12 and provides a transmitter output which is representative of the sensed parameter.

Transmitter 10 comprises a sensing means 14, having a sensor 16 responsive to the parameter and an excitation means 18 for providing an excitation output along a line 20 for exciting the sensor 16. Sensing means 14 provides a sensor output which varies as a function of the excitation output and the parameter to be sensed. The sensor output is coupled along a line 22 to an output means 24 for providing the transmitter output as a function of the sensor output to a two-wire loop 26. In a preferred embodiment, the sensor output is also coupled along a line 28 to a threshold detection means 30 which is fully described below.

Transmitter 10 further comprises output terminals 32 and 34 coupled to two-wire loop 26 along lines 36 and 38, respectively. An energization source 40 couples in series with loop 26 between lines 36 and 42 and provides energization to transmitter 10. Transmitter 10 further comprises a regulator 44 coupled to a line 46 for receiving a portion of a loop current $I_T$ and for energizing further transmitter circuitry with controlled levels of energization in a conventional manner. Substantially all of the portion of loop current $I_T$ is returned along a common conductor 48 through a resistance 50 to output terminal 34. Output means 24 further comprises a means for current control coupled along line 46 to output terminal 32 and coupled along a line 52 through resistance 50 to output terminal 34. Output means 24 controls current $I_T$ in loop 26 as a function of the sensed parameter and, hence, current $I_T$ is the transmitter output. Loop current $I_T$ is preferably a direct current, such as a 4–20 milliampere current, which is preferably linearly proportional to the sensed parameter. Output means 24 is also coupled along a line 54 to output terminal 34 for sensing a potential developed across resistance 50. The potential thus developed is representative of loop current $I_T$. Output means 24 can thus monitor loop current $I_T$ and provide closed loop control of loop current $I_T$. A resistance 56 is coupled between lines 38 and 42 in loop 26. The loop current $I_T$ flows through resistance 56. A utilization device 58 coupled to resistance 56 uses a potential developed across resistance 56. Utilization device 58 can comprise a control computer, loop controller, chart recorder, meter or other indicating, recording or control apparatus.

An undesired change in the excitation output, however, can cause a sensor output and a transmitter output which are not substantially representative of the sensed parameter. According to the present invention, threshold detection means 30 functions to detect such undesired changes in excitation output. Threshold detection means 30 has at least one predetermined threshold value which substantially corresponds to a predetermined sensor output value produced in response to such undesired change in excitation output. Threshold detection means 30 compares the sensor output against the threshold value and provides a detector output to output means 24 as a function of such comparison along a line 60. Following detection of an undesired change in excitation output, for example, output means 24 provides a distinctive transmitter output representative of such detected excitation output change, thereby improving the output of the transmitter 10.

In a preferred embodiment, sensing means 14 further comprises a means for feedback of the sensor output to sensing means 14, as indicated by a dashed line at 62, such that the excitation output varies as a function of the sensor output. Sensor 16 and excitation means 18 thus operate in a closed-loop relationship, wherein an undesired change in the excitation output is produced in response to at least one predetermined sensor output value. A threshold value is selected which substantially corresponds to such predetermined sensor output value, against which the sensor output is compared for detection of undesired changes in excitation output.

Figure 2:
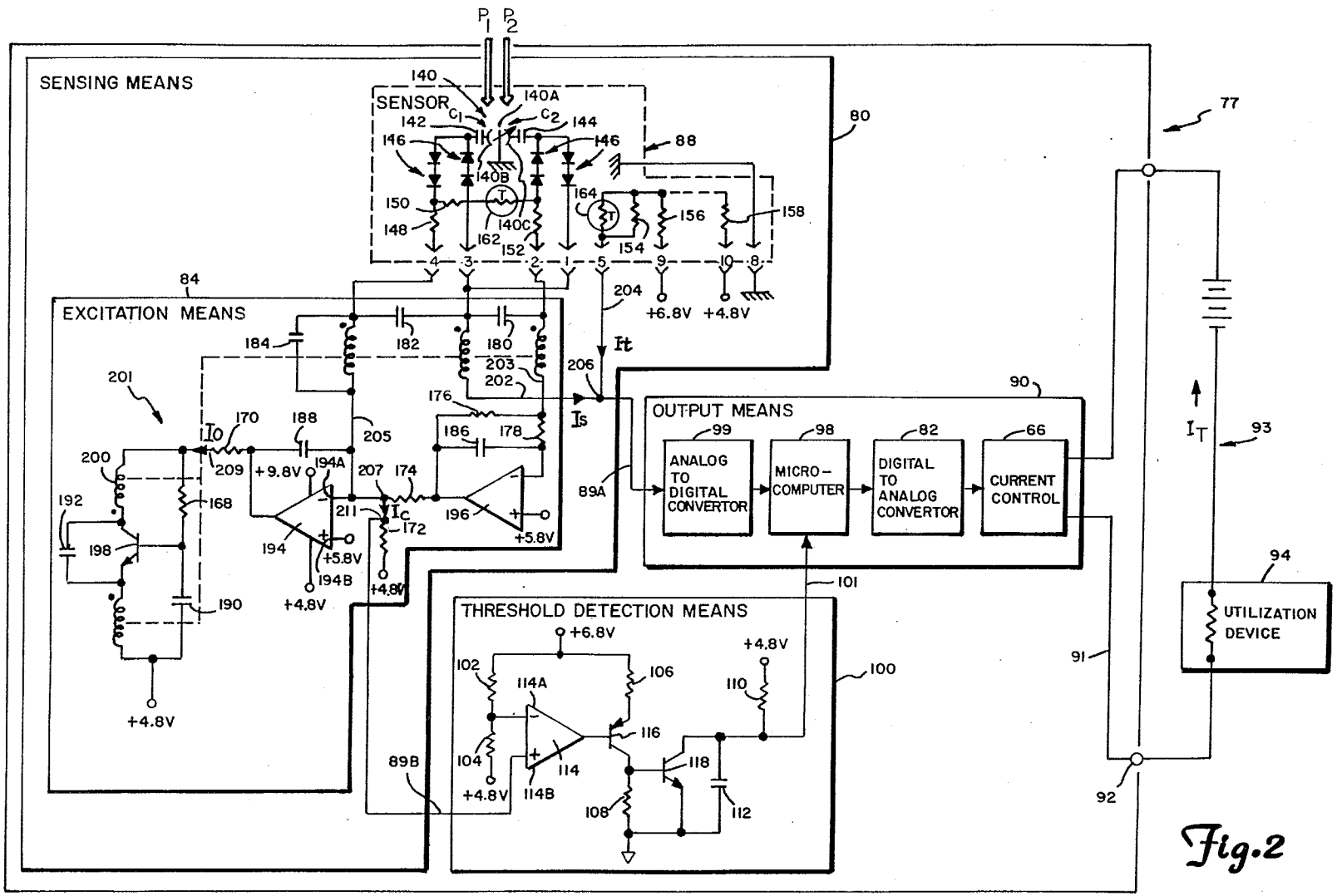
FIG. 2 is a further preferred embodiment of a two-wire transmitter having a threshold detection circuit.

In a further preferred embodiment of the present invention, a two-wire transmitter is partially shown at 77 in FIG. 2, for providing a transmitter output representative of a parameter to be sensed, such as a differential in pressure $P_2-P_1$. Transmitter 77 comprises a sensing means 80 for sensing a differential pressure, having a sensor shown enclosed in a dashed line at 88 which is responsive to the differential in pressure. Sensor 88 is coupled to an excitation means 84 for providing an excitation output for exciting sensor 88 such that sensing means 80 provides a sensor output which varies as a function of the excitation output and the differential in pressure being sensed.

Sensor 88 comprises a capacitive pressure sensing cell 140 coupled through fixed capacitors 142 and 144 to an array of rectification diodes 146. Sensor 88 further comprises selected fixed resistances 148, 150, 152, 154, 156, 158 and thermistors 162 and 164 which are compensation components coupled together with sensing cell 140 and fixed capacitors 142 and 144 to provide analog temperature compensation of sensing cell 140.

Sensing cell 140 schematically shown in FIG. 2 comprises a differential capacitance transducer, such as the type described in U.S. Pat. No. 3,618,390 to Roger L. Frick, entitled "Differential Pressure Transducer", or that described in U.S. Pat. No. 4,370,890 to Roger L. Frick, entitled "Capacitive Pressure Transducer with Isolated Sensing Diaphragm", which are held by the same assignee as the present invention. The sensed parameter, a differential in pressure, is useful for determining, for example, a velocity of flow of process fluid through an orifice disposed in a conduit, where a first pressure $P_1$ downstream of the orifice and a second pressure $P_2$ upstream of the orifice correspond to pressures which the fluid exerts on opposite sides of the orifice.

Sensing cell 140 comprises a deflectable sensing diaphragm 140A which is disposed between two spaced-apart, stationary capacitor plates 140B and 140C. Capacitor plates 140B and 140C are disposed on concave-shaped walls of sensing cell 140 and are separated by sensing diaphragm 140A to form a pair of variable capacitors $C_1$ and $C_2$, whose capacitance varies proportional to the position of sensing diaphragm 140A relative to capacitor plates 140B and 140C. One side of sensing diaphragm 140A is coupled to the first pressure $P_1$ while the opposite side is coupled to the second pressure $P_2$. A differential in pressure applied across sensing diaphragm 140A thus causes the diaphragm to deflect toward the lower pressure side, thereby changing the capacitances of capacitors $C_2$ and $C_1$, the differential capacitance of which is representative of the differential in process fluid pressure $P_2-P_1$ being sensed.

Excitation means 84 comprises resistors 168, 170, 172, 174, 176 and 178, capacitors 180, 182, 184, 186, 188, 190 and 192, amplifiers 194 and 196, transistor 198, and transformer 200 which has five windings coupled together for providing excitation. Operation of excitation means 84 in cooperation with sensor 88 is substantially as described in U.S. Pat. No. 3,646,538 to Roger L. Frick, entitled "Transducer Circuitry For Converting a Capacitance Signal to a DC Current Signal", held by the same assignee as the present invention and which is incorporated herein by reference.

Transmitter 77 further comprises an output means 90 which is coupled to a sensor output along line 89A, for providing a transmitter output along a line 91 to a transmitter output terminal 92 coupled to a two-wire loop 93 for transmission to a suitable utilization device 94 for indicating, recording or control purposes. The transmitter output is preferably a direct current, such loop current $I_T$ having a predetermined range such as a 4–20 milliampere current which is representative of the sensor output. Output means 90 comprises an analog-to-digital convertor 99, a microcomputer 98, a digital-to-analog convertor 82 and a current control 66. A sensor output is coupled along line 89A to analog-to-digital convertor 99 which performs an analog-to-digital conversion of the sensor output and presents a converted digital output to microcomputer 98. Microcomputer 98 comprises means for calculating a desired transmitter output value as a function of the digital output from analog-to-digital converter 99 and presents a microcomputer output representative of the calculated transmitter output value to digital-to-analog convertor 82. Digital-to-analog convertor 82 performs a digital-to-analog conversion of the microcomputer output and presents an output representative of the calculated transmitter output value to the current control 66. Current control 66 comprises means for controlling the loop current $I_T$, such as the amplitude, as a function of the output from digital-to-analog converter 82, such that loop current $I_T$ is representative of the calculated transmitter output value. Operation of output means 90 in cooperation with sensor 88 and excitation means 84 is substantially as described in co-pending U.S. Patent application Ser. No. 188,110, filed on Apr. 28, 1988, entitled "Digital Converter Apparatus for Improving the Output of a Two-Wire Transmitter", held by the same assignee of the present invention and is incorporate herein by reference, and is a continuation of now abandoned application Ser. No. 914,648.

Excitation means 84 comprises a conventional oscillator circuit 201 for providing a time varying oscillator output for exciting sensing cell 140. In this embodiment, sensing means 80 further comprises means for feedback of sensor output to oscillator circuit 201, such that the oscillator output varies as a function of the sensor output. Sensor output is coupled from sensor connectors 2 and 4 along lines 203 and 205 respectively to oscillator circuit 201 as feedback, where it is summed at node 207, comprising a control current "Ic" which is proportional to the product of the frequency and amplitude of the oscillator output and the sum of the capacitances of $C_1$ and $C_2$. Sensor 88 couples a sensor current "Is" representative of the sensed differential in pressure $P_2-P_1$ along line 202 to a node 206. Sensor 88 also couples an analog temperature compensation current "It" along line 204 to node 206. Sensor current Is and temperature compensation current It are thus summed at node 206, comprising a temperature compensated sensor output which is proportional to the product of the frequency and amplitude of the oscillator output and the difference of the capacitances of $C_1$ and $C_2$, which sensor output is coupled along line 89A to output means 90.

Excitation means 84 further comprises a means for controlling the oscillator output as a function of the sensor output. In this embodiment, an oscillator control amplifier 194 comprises the means for controlling the amplitude of the oscillator output as a function of control current Ic. Oscillator control amplifier 194 preferably is a high-gain operational amplifier which provides an oscillator supply current "Io" through resistor 170 along line 209 in response to a differential input signal derived from potentials presented at its inverting terminal 194A and its non-inverting terminal 194B. The potential presetted at inverting terminal 194A is representative of control current Ic, and the potential presented at non-inverting terminal 194B is a fixed potential. The fixed potential at non-inverting terminal 194B and the resistance value of resistor 170 are selected such that a desired oscillator output is provided during operation of transmitter 77 under normal conditions, e.g., while the desired control of oscillator circuit 201 is being maintained. Capacitor 188 connects between the output of oscillator control amplifier 194 and inverting or degenerative input terminal 194A to provide dynamic stability. In operation, the differential input signal derived by oscillator control amplifier 194 causes a change in oscillator supply current Io, thereby changing the amplitude of the oscillator output. Output from driven sensing cell 140, which is a function of the changed oscillator output and the parameter being sensed, is fed back as control current Ic to oscillator control amplifier 194 which further adjusts the oscillator supply current Io in response thereto. Excitation means 84 and sensor 88 thus operate in a closed-loop relationship to maintain control current Ic at a relatively constant level during normal operating conditions.

The frequency of oscillator circuit 201 is determined by the inductance of transformer 200 and capacitances associated with the circuit, primarily those of variable capacitors $C_1$ and $C_2$ which are driven by the oscillator output, all of which cooperate as a resonant frequency determining circuit. The frequency of the oscillator output in one preferred embodiment, for example, varies nominally about a desired oscillator frequency of approximately 30 kilohertz, when coupled to a pressure differential which is within the normal range of operation of sensing cell 140 and the desired control of oscillator circuit 201 is being maintained.

During operation of transmitter 77 under normal conditions, for example, oscillator circuit 201 is controlled such that a sensor output representative of the sensed differential in pressure is produced. As, for example, an increase in pressure differential is sensed by transmitter 77, the control current Ic, which is a function of the sum of the capacitances of $C_1$ and $C_2$, will momentarily increase prior to correction by the controlled oscillator circuit 201. To maintain the desired control of oscillator circuit 201, oscillator control amplifier 194 will cause a reduction in oscillator supply current Io in response to the increased potential presented at its inverting terminal 194A, which potential is a function of the increased control current Ic. Such adjustments are continuously made by oscillator control amplifier 194 during operation of transmitter 77 under normal conditions, such that a substantially constant control current level is maintained and a transmitter output which is proportional to the sensed differential in pressure is provided.

A loss, however, of the desired control of oscillator circuit 21 can produce an undesired change in the oscillator output, resulting in a sensor output and transmitter output which are not substantially representative of the differential in pressure to be sensed. Such loss of desired control can result, for example, from defects in the components comprising excitation means 84 or sensor 88, including without limitation such components as transformer 200, oscillator control amplifier 194, sensing cell 140, and rectification diodes 146, as well as subjecting sensing cell 140 to operating conditions which exceed the normal operating range of the cell, e.g., overpressure conditions.

Consider, for example, operation of transmitter 77 when second pressure $P_2$ is sufficiently greater than first pressure $P_1$, such that sensing diaphragm 140A is caused to bottom out adjacent the concave wall of sensing cell 140 on which capacitor plate 140B is disposed. Since the capacitance of each variable capacitor $C_1$ and $C_2$ is inversely proportional to the spacing between sensing diaphragm 140A and the respective capacitor plates 140B and 140C, a bottoming out of the sensing diaphragm on one side of sensing cell 140 during an overpressure condition can produce a very large capacitance value in the variable capacitor receiving the deflection, and in some instances a short circuit between the sensing diaphragm and adjacent capacitor plate can occur. Such an overpressure condition thus can produce a large increase in control current Ic. The control current Ic resulting from such an overpressure condition can become sufficiently large that the reduction in oscillator supply current Io made by oscillator control amplifier 194 in response thereto produces an oscillator supply current Io which is insufficient to drive oscillator circuit 201 at the desired frequency. As a result, oscillator circuit 201 can shift to an undesired resonant frequency mode producing an oscillator output having a reduced frequency and amplitude, thereby causing a reduction in control current Ic below the level needed for the desired control of oscillator circuit 201 to be maintained. Such undesired changes in oscillator output can introduce error in sensor output, thereby producing transmitter output which is not substantially representative of the parameter being sensed.

According to the present invention, transmitter 77 further comprises a threshold detection means 100 coupled along line 89B to a potential representative of control current Ic at a node 211. Threshold detection means 100 comprises resistors 102, 104, 106, 108 and 110, capacitor 112, amplifier 114, and transistors 116 and 118. A potential representative of an actual value of control current Ic, which is a function of the oscillator output, is coupled along line 89B to a non-inverting input terminal 114B of amplifier 114. Resistors 102 and 104 are coupled in series forming a resistive voltage divider which couples a fixed potential to an inverting input terminal 114A of amplifier 114. The fixed potential comprises a predetermined threshold value corresponding to an undesired control current value. Amplifier 114 functions as a differential amplifier, comparing a potential presented at its non-inverting terminal 114B with a potential presented at its inverting terminal 114A, and providing an output representative of such comparison. In operation for example, detection of an actual control current value, as represented at non-inverting terminal 114B, which exceeds the predetermined threshold value, as represented at inverting terminal 114A, indicates that the desired control of the oscillator circuit 201 is being maintained, producing a high amplifier output value. Detection, however, of an actual control current value which is equal to or less than such predetermined threshold value is indicative of a condition at which the desired oscillator circuit control can no longer be maintained, such as due to a circuit failure condition of excitation means 84 or sensor 88, or an overpressure condition, and a low amplifier output is provided. The output of amplifier 114 is thus representative of the occurrence of an undesired change in the oscillator output produced responsive to such loss of desired oscillator circuit control.

In the preferred embodiment, resistors 106, 108 and 110, capacitor 112, and transistors 116 and 118 are coupled together comprising means for level shifting the output of amplifier 114, such that a detector output, which is provided by threshold detection means 100 along a line 101 to output means 90, is compatible with the input requirements of microcomputer 98. During operation while desired oscillator circuit control is being maintained, for example, a high output value provided by amplifier 114 does not bias transistors 116 and 118 on, and level shifting is provided by resistor 110 to produce a detector output value having a high logic level which is compatible with input requirements of microcomputer 98. Following detection of a loss of desired oscillator circuit control, however, a low amplifier output is level shifted to produce a selected detector output value having a low logic level which is also compatible with microcomputer 98. The detector output is smoothed by capacitor 112. Such level shifting, for example, permits threshold detection means 100 and microcomputer 98 to be energized from supplies having different potentials. Microcomputer 98 further comprises means responsive to the selected detector output value, such that a distinctive transmitter output representative of such undesired change in the oscillator output is provided by output means 90.

The distinctive transmitter output provided by transmitter 77 can comprise, for example, a shift in the loop current to a preselected level above or below that of the predetermined transmitter output range, e.g., a current which is above or below a 4–20 milliampere loop current. In the preferred embodiment, for example, the distinctive transmitter output can comprise a 20.8 milliampere loop current representative of an undesired change in oscillator output resulting from a positive overpressure condition caused by a bottoming out of the sensing diaphragm 140A adjacent capacitor plate 140B, and a 3.9 milliampere loop current representative of an undesired change in oscillator output resulting from a negative overpressure condition caused by a bottoming out of the sensing diaphragm adjacent capacitor plate 140C.

Although the present invention has been described with reference to preferred embodiments, workers skilled in the art will recognize that changes may be made in form and detail without departing from the spirit and scope of the invention.

I claim:

1. A two-wire current transmitter for providing a transmitter output which is representative of a parameter to be sensed, comprising:

sensing means, having a sensor responsive to the parameter and an excitation means coupled to the sensor for providing an excitation output for exciting the sensor, for providing a sensor output which varies as a function of the excitation output and the parameter to be sensed;

output means coupled to the sensor output for providing the transmitter output as a function of the sensor output to the two-wire circuit; and threshold detection means coupled to the sensor output, having at least one predetermined threshold value, for providing a detector output to the output means as a function of the sensor output and the threshold value, such that the transmitter output is further representative of an undesired change in the excitation output.

2. The transmitter of claim 1, wherein the sensing means further comprises means for feedback of the sensor output to the excitation means such that the excitation output varies as a function of the sensor output.

3. The transmitter of claim 2, wherein the undesired change is produced responsive to at least one predetermined sensor output value, and wherein the threshold value is representative of the predetermined sensor output value.

4. The transmitter of claim 3, wherein the threshold detection means comprises a means for comparing the sensor output and the threshold value and providing the detector output as a function of such comparison.

5. The transmitter of claim 4, wherein the output means is coupled to the threshold detection means and includes means for providing a distinctive transmitter output representative of a selected detector output value.

6. The transmitter of claim 3, wherein the excitation means comprises an oscillator means for providing a time varying oscillator output for exciting the sensor.

7. The transmitter of claim 6, wherein the feedback means further comprises a control means coupled to the sensor output and the oscillator means for controlling the oscillator output as a function of the sensor output.

* * * * *

UNITED STATES PATENT AND TRADEMARK OFFICE

CERTIFICATE OF CORRECTION

PATENT NO. : 4,804,958

DATED : February 14, 1989

INVENTOR(S) : Randy J. Longsdorf

It is certified that error appears in the above-identified patent and that said Letters Patent is hereby corrected as shown below:

In the References Cited Section, under U.S. PATENT DOCUMENTS, list the following Patents:

| | | | |
|---|---|---|---|
| 3,618,390 | 11/09/71 | Frick | 73/398 C |
| 3,646,538 | 02/29/72 | Frick | 340/200 |
| 4,033,188 | 07/05/77 | Herzl | 73/194 VS |
| 4,250,490 | 02/10/81 | Dahlke | 340/870.37 |
| 4,370,890 | 02/01/83 | Frick | 73/718 |
| 4,549,180 | 10/22/85 | Masuda | 340/870.04 |
| 4,586,108 | 04/29/86 | Frick | 361/283 |
| 4,598,381 | 07/01/86 | Cucci | 364/558 |

Column 4, line 41, delete "incorporate" and insert "incorporated".

Column 5, line 10, delete "presetted" and insert "presented".

Signed and Sealed this

Sixth Day of June, 1989

*Attest:*

*Attesting Officer*

DONALD J. QUIGG

*Commissioner of Patents and Trademarks*